United States Patent [19]

Riegler et al.

[11] 4,317,969

[45] Mar. 2, 1982

[54] ELECTRICAL LINE-CONNECTOR

[76] Inventors: Hannes Riegler; Ulrich Wittwer, both of Chalet Rothusi, 3818 Grindelwald Cheminees Isolationen, Umbauten von Kuchen, Bader, Switzerland

[21] Appl. No.: 938,962

[22] Filed: Sep. 1, 1978

[51] Int. Cl.[3] ..... H01H 21/00

[52] U.S. Cl. ..... 200/52 R; 200/51.09; 335/205; 339/12 R

[58] Field of Search ..... 200/51.09, 52R; 339/12 R; 335/205, 207

[56] References Cited

U.S. PATENT DOCUMENTS 2,573,920 11/1951 McLeod ..... 200/51.09
3,521,216 7/1970 Tolegian ..... 339/12 R

OTHER PUBLICATIONS

German Application, Offenlegungsschrift No. 2643031 Published Mar. 30, 1978.

*Primary Examiner*—Gene Z. Rubinson
*Assistant Examiner*—Morris Ginsburg
*Attorney, Agent, or Firm*—Robert M. Hessin

[57] ABSTRACT

An electrical line-connector device for safety application. The electrical contacts of the two-part line-connector which connect electrical conductors with one another are flush contacts, which come into contact when the connecting parts are brought together. Each connecting part contains a part of a holding-magnet arrangement which includes a permanent magnet, assuring the holding-together of the connecting parts and the required contact pressure. The one connecting part contains a switch device which is formed in such a way that the flush contacts only carry voltage when the connecting parts are placed together. The switch device can be a familiar magnetic switch, which is switched on by the permanent magnet in the other connecting part when the connecting parts are placed together.

4 Claims, 6 Drawing Figures

ELECTRICAL LINE-CONNECTOR

BACKGROUND OF THE INVENTION

1. Field of the Invention

The invention refers to a safety line-connector for electrical connections with two matching connecting parts which fit together, each of which contains contact pieces for connecting to wiring, and one of which contains a switch mechanism through which at least one of its contact pieces is connected with its wiring terminal only when the connecting parts are fitted together.

2. Description of the Prior Art

The most common line-connectors are sockets and plugs of the most various types. Such plug connections assure a good electrical connection of the lines when the plug pins are seated right in the sockets, but are in the simplest models not contact safe. In order to attain sufficient contact safety with such simple outlets, especially for playing children, the well-known safety disc inserts have been developed, which, when inserted in the outlets, permit access to the socket openings only after adjustment of a cover disc held in the closed position by a spring. After somewhat more frequent use, slight damage can already occur in the safety disc inserts, which makes the insertion of a plug, which even normally requires a certain skill, into a laborious task, so that the disc inserts are frequently taken out again.

With plug devices for voltages above 250 V, the outlet is often combined with a switch which must be turned off before the plug can be withdrawn. The providing of switch contacts between sockets and voltage-carrying lines provides a satisfactory degree of contact safety for the outlets, and so it has also already been suggested that a magnetic switch in the outlet be provided, which, for example, is operable by a permanent magnet built into the plug, so that when the plug is inserted into and withdrawn from the outlet, the switch is automatically closed and opened, respectively, and there is no voltage in the socket when the plug is not in it German DE-OS No. 1 515 487).

Not only in trade and industry, but also otherwise in daily life these days, a multiplicity of electrical appliances are used, which are connected by cord and plug to outlets, often also to multiple outlets. Every such "flying" line holds the danger that, for example, when it is stumbled over, an appliance can be pulled from the table, a lamp tipped over, etc., and/or plug and outlet damaged, so that not only costly damages can arise, but it can also result in an accident. The traditional plug devices therefore in no way meet all safety requirements; not even when they are made safe from contact.

It is an object of the invention to create a safety line-connector which is not only safe from contact but also from the aforementioned mechanical influences and the like, and which is in addition simple to operate, cost-saving to produce and can also be produced in small sizes.

The invention's solution to the task consists in the contact pieces of the connecting parts being flush contacts, and each connecting part having a part of a holding-magnet arrangement containing at least one permanent magnet. The holding-magnet arrangement is hereby so calculated that when the connecting parts are brought together, a contact pressure sufficient for a secure contact between the flush contact pieces is maintained, but the connecting parts can be easily separated by an unintentional mechanical influence, so that practically no damage can occur. Because of the switch mechanism contained in the first connecting part, which is connected, for instance, to a source of current, the line-connector is contact-safe. The permanent magnet of the holding-magnet arrangement is functionally contained in a second connecting part connected, for example, to an appliance. The presence of this permanent magnet makes it expedient to use a magnetic switch as switching device, although any other switching device desired can be used, as long as there is assurance that when the connecting parts are separated the hot switch piece of the first connecting part is kept free of voltage by the switch device.

In the further development of the invention, the holding-magnet in the first connecting part, which contains the switch device, is movable from an unoperated position in which the switch device is set to break the connection between the contact piece and its wiring terminal, into an operated position, in which the connection between contact piece and wiring terminal is made and the permanent magnet contained in the second connecting part serves to move the holding-magnet part in the first connecting part. The movable holding-magnet part is in the first connecting part preferably arranged in a space closed off by a plate on the front of the connecting part, so that neither dust nor moisture can penetrate into the connecting part. In the further development of the invention, with a simple line-connector especially suited for low currents, the plate closing off the space with the holding-magnet is itself a contact piece, and the permanent magnet contained in the second connecting part and fitting to this plate carries the opposite contact to this plate-contact piece, whereby when the movable holding-magnet part is in the operated position, the opposite contact is electrically connected through the contact plate, the movable holding-magnet part and the switch device to its wiring terminal. Such line-connectors can be produced in very small sizes, as are common in many cases, especially for the connecting of small appliances.

In a further development of the invention, both parts of the holding-magnet arrangement are cylindrical bodies and each further contact piece of the first and second connecting parts is a ring-segment-contact concentric with the holding magnet part, so that the line connector is polarized.

In the following Figures the invention is explained in more detail with the use of examples of models, with reference to the attached drawing. There we see:

Figure 5A:
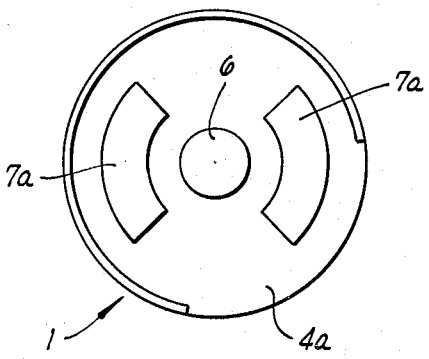
Figure 5B:
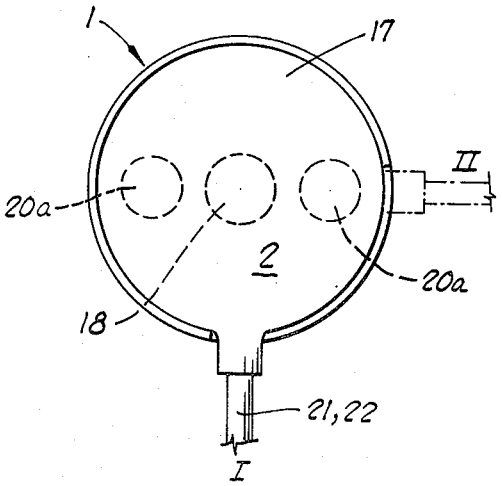

FIGS. 5*a* and 5*b* depict a further development of a line-connector after the invention.

Figure 1:
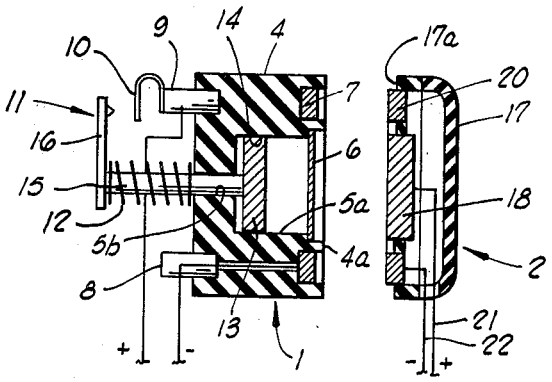
FIG. 1 illustrates in schematic form a longitudinal section through a line-connector after this invention, with a holding-magnet arrangement which itself serves as part of the connection.
Figure 2:
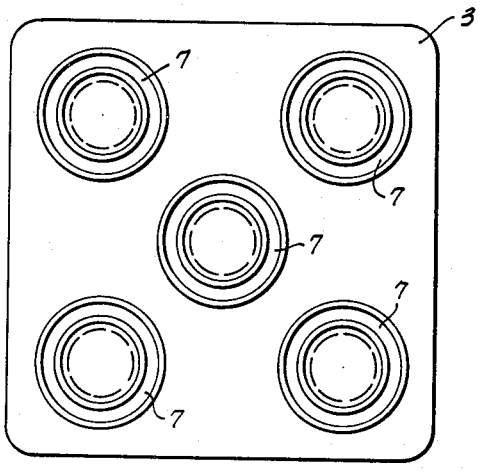
FIG. 2 is a perspective view of a multiple connecting part of a line-connector after the invention.

The safety line-connector shown in FIG. 1 in purely schematic form is suitable, for instance, for the supplying of DC current to small appliances such as transistor radios, calculators, etc., therefore for rather wide use today. The one connecting part corresponding to the outlet, in the following text referred to as "distributor part" or "distributor" 1, and the other connecting part corresponding to the plug, which is designated as "collector part" or "collector 2", together constitute the line-connector. Frequently, several such devices are connected simultaneously. FIG. 2 shows in perspective a distributor element 3 with five distributor parts 7, which in the present example can be connected to a converter delivering DC, or be built onto the same. Because of the low voltage contact safety is not required, although the distributor part must be short-proof. An additional requirement here is the polarized nature of the line-connector.

The distributor part 1 shown in FIG. 1 has a cylindrical housing block 4 made of electrically insulating material, which contains a center bore hole 5*a*, 5*b*, which is narrowed once. The front section 5*a* of the bore-hole, with the larger diameter, is closed off at the front of the housing 4 with a relatively thin and electrically good conducting plate 6, which constitutes in this model the one contact pole of the distributor 1, and is therefore, for purposes of satisfactory contact, preferably elastic and equipped with a profile. The other contact pole of the distributor part 1 consists of a contact ring 7, which is set into the front 4*a* of the housing, surrounding the contact plate 6. On the rear, the housing 4 has a first connecting terminal 8, which is electrically connected in the housing 4 with the contact ring 7, and has, electrically insulated, a second terminal 9, which as fixed contact of a switch device 11 is equipped for instance with a contact spring 10. The switch device 11 is a special form of a familiar magnetic switch which in a state of rest is held open by a retaining spring 12 and can be closed by the placing of a permanent magnet on the housing, for instance.

The magnetic switch 11 is here represented in the form of an axially sliding piston in the center bore-hole 5*a*, 5*b*, whereby the piston is the movable part of a holding-magnet arrangement. The piston-shaped movable holding-magnet part 13 in the front bore-hole section 5*a* consists of a magnetic material, iron, for instance, and is brought by means of a rod 15 to the rear section 5*b* of the bore-hole. The rod 15 has, as movable contact of the magnetic switch 11, a contact bridge 16. The retaining spring 12 is arranged here on the rod 15 between contact bridge 16 and housing 4. When the piston-shaped clasp-magnet part 13 is pushed forward against the force of the retaining spring 12 by means of a permanent magnet placed outside on the contact plate 6, the holding-magnet part 13 lies next to the contact plate 6, and the contact bridge 16 is in contact with the contact spring 10.

In the model in FIG. 1, the plate 6 is, as mentioned, the one contact pole of the distributor part 1. When the magnetic switch 11 is closed, there is therefore voltage in the plate 6, and in order to attain a small transitional resistance, the surface of the holding-magnet part 13 of magnetic material is covered with a good-conducting layer 14 of silver, for instance. The rod 15 of electricity-conducting material such as copper or brass is in electrical contact with the contact bridge 16.

The collector part 2 of the line-connector consists of a flat housing 17 of electrically insulating and non-magnetic material such as plastic, which has on its front surface 17*a* a preferably flush permanent magnet 18 which fits to the plate 6 of the distributor part 1 and a collector contact-ring 20 which concentrically surrounds the permanent magnet 18 and fits to the contact ring 7 of the distributor part 1. Since the permanent magnet 18 is simultaneously the one contact pole of the collector part 2, its surface is covered with a layer of a good electrical conductor such as silver. In the housing 17 the two wires 21 and 22 are connected to the permanent magnet 18 and the contact-ring 20. The collector part 2 can be very flat, whereby the permanent magnet 18, the contact-ring 20 and the connected ends of the wires 21, 22 can be cast in a plastic body, so that the result is a collector part very sturdy in use and best suited for mass production.

The permanent magnet 18 of the collector part 2 and the piston shaped holding-magnet 13 of the distributor part 1 are in regard to the size and magnetic induction of the permanent magnet 18 so calculated, that when the permanent magnet is placed on the plate 6, the collector part 2 adheres sufficiently firmly to the distributor part 1, and the magnetic switch is held closed for a secure contact. The clasp-magnet part 13 can likewise be a permanent magnet, but it must be relatively weak, so that a piece of iron laid on the plate 6 cannot close the switch 11.

The branch 1 is completely sealed off, so that neither dust nor moisture can penetrate. The line-connector has a polarized design. Since with the line-connector of FIG. 1 the current is carried through the holding-magnet arrangement 13, 18, the line-connector is usable for relatively weak-intensity currents.

Figure 3:
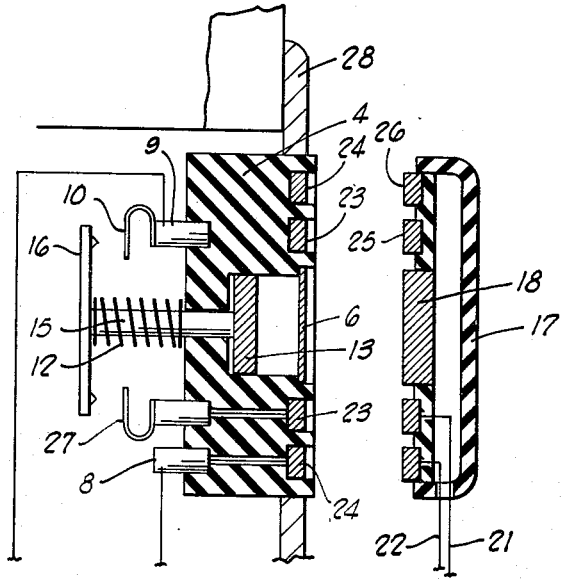
FIG. 3 illustrates in schematic form a longitudinal section through a line-connector after the invention, with a holding-magnet arrangement and separate connecting contacts.

A line-connector for high-intensity currents is shown in FIG. 3. This line-connector is basically made like the one in FIG. 1, with the distinction that here the current is not carried through the holding-magnet arrangement 18, 13, and that the plate 6 of the distributor part 1 as well as the permanent magnet 18 of the collector part 2 are each surrounded by two concentric contact-rings 23, 24 and 25, 26 respectively. With the distributor part 1 the outer contact-ring 24 is connected with the terminal 8, on which the neutral or the ground wire is to be connected. The inner contact-ring 23 is connected to a fixed spring-contact 27, which, for example, is arranged diametrically opposite to the contact-spring 10 on the terminal 9. The rod 15 which has the contact bridge 16 consists of electrically insulating material. When the holding-magnet part 13, which can now be without a layer, is pushed forward, the contact bridge 16 connects the contact springs 10 and 27, so that there is then voltage on the inner contact-ring 23. The distributor part of FIG. 3 is intended for recessed mounting and has a cover plate 28. Polarity is also assured with this model.

Figure 4:
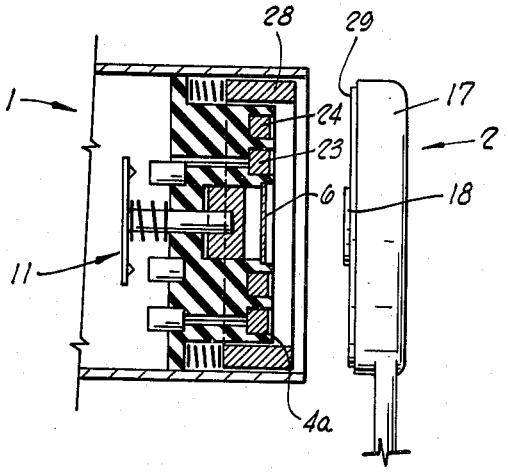
FIG. 4 illustrates in schematic form a line-connector with grounding.

FIG. 4 shows a line-connector with grounding. The connector corresponds to the one shown in FIG. 3, with the difference that the distributor part 1 and the collector part 2 each have an additional ground contact. In the model shown, the ground contact of the distributor part 1 consists of a ground ring-contact 28 which is springy in the axial direction and stands out in front of the front surface 4*a*, which contains the two contact-rings 23 and 24 and the plate 6. The collector part 2 contains a ground ring-contact 29 which fits to the ring-contact 28. When the collector part 2 is placed on the distributor part 1, the two grounding rings 28 and 29 make at first a loose contact with each other, and the magnetic switch 11 is opened. In order that the magnetic switch 11 closes, the permanent magnet 18 must be placed on the plate 6 of the distributor part 1; that is, the collector part 2 must be pressed against the spring force of the grounding ring 28 onto the distributor part 1.

With this pressing the ground connection is made secure. Only after that does the magnetic switch 11 close. The ground ring-contact 28 can also be fixed in distributor part 1 and a springy ground ring-contact 29 be provided in collector part 2. The one ground ring-contact can also be replaced by grounding pins.

In the models described, the current-carrying contacts are in the form of ring-contacts. These contacts can of course also be given any other form desired.

FIG. 5*a* shows the front side 4*a* of a distributor part 1 which corresponds to FIG. 1, in which the contact-ring 7 of FIG. 1 is divided into two ring segments 7*a*, which lie diametrically opposite to each other. FIG. 5*b* shows in perspective the line-connector with the applied collector part 2, which instead of the contact ring 20 of FIG. 1, contains two contact pieces 20*a* which fit on the contact-ring segments 7*a*. With this line-connector there are two positions, I and II (FIG. 5*b*). In position I the contact pieces 20*a* of the collector part 2 are against the contact-ring segment 7*a* of the distributor part 1, so that when the magnetic switch is turned on, the connected wires 21, 22 carry current. In position II on the other hand, these contacts are not against each other, so that the wires 21, 22 carry no current. If with such a model of the line-connector the collector part 2 is made so that it can be turned on the distributor part 1 to the positions I and II (FIG. 5*b*), then the line connector receives an additional switching function; that is, in order to turn off a connected appliance, the line-connector need not be separated.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A safety connector for electrical connections with two mating connector parts that fit together, each of which connector parts contains contacts connected to electrical wiring, comprising:

first and second connector parts each having a planar contact face for joining abutment and relative rotational positioning;

first and second contacts disposed in generally planar disposition on the first contact face of said first connector part, said first contact being central and said second contact being peripheral to the first contact face;

first and second contacts disposed in generally planar disposition on the second contact face of said second connector part, said first contact being central and said second contact being peripheral to said second contact face, said first central contact being constituted of permanent magnet material;

spring loaded contact means disposed in said second connector part to be magnetically attractable to electrically connect to said central first contact of said first connector part when the planar contact faces are placed in juxtaposition;

switch means in said second connector part connected to said electrical wiring in current conductive mode only when said spring loaded contact means is magnetically attracted; and means for limiting the relative positioning of said first and second connector parts between a first position wherein respective first and second contacts of the first and second connector parts are in electrical contact and a second position at least 90° displaced wherein the respective second contacts of said first and second connector parts are not in conductive contact.

2. A safety connector as set forth in claim 1 which is further characterized in that:

a contact plate means is disposed centrally in the contact face of said second connector part; and said spring loaded contact means is movable axially of said second connector part to contact said contact plate means when magnetically attracted.

3. A safety connector as set forth in claim 2 wherein said switch means comprises:

a first normally open contact secured in electrically conductive connection on said spring loaded contact means; and contact terminal means secured insulatively on said second connector part and being connected to said electrical wiring.

4. A safety connector as set forth in claim 1 wherein said second contacts are arcuate contacts and said first contacts are centrally disposed on said respective contact face in relation to said arcuate contacts, said arcuate second contacts in each of said first and second connector parts being in electrical communication.

* * * * *